US008272244B2

(12) United States Patent
Hoffman

(10) Patent No.: US 8,272,244 B2
(45) Date of Patent: Sep. 25, 2012

(54) STAMPING APPARATUS WITH FEED DEVICE

(76) Inventor: Frank Hoffman, Quickborn (DE)

( * ) Notice: Subject to any disclaimer, the term of this patent is extended or adjusted under 35 U.S.C. 154(b) by 648 days.

(21) Appl. No.: 12/295,290

(22) PCT Filed: Mar. 22, 2007

(86) PCT No.: PCT/EP2007/052741

§ 371 (c)(1),
(2), (4) Date: Feb. 18, 2009

(87) PCT Pub. No.: WO2007/113120

PCT Pub. Date: Oct. 11, 2007

(65) Prior Publication Data

US 2009/0165524 A1 Jul. 2, 2009

(30) Foreign Application Priority Data

Mar. 29, 2006 (DE) ..... 10 2006 014 454

(51) Int. Cl.
*B21D 28/02* (2006.01)

(52) U.S. Cl. ..... 72/361; 72/405.02; 72/405.09; 72/405.11; 72/420; 413/62

(58) Field of Classification Search ..... 72/361, 72/405.01, 405.02, 405.09, 405.11, 405.12, 72/405.13, 419–422, 423–428; 413/62, 64, 413/70

See application file for complete search history.

(56) References Cited

U.S. PATENT DOCUMENTS 1,981,875 A * 11/1934 McDonald ..... 99/450.6
1,982,742 A * 12/1934 Keenan ..... 99/509
2,159,779 A * 5/1939 Cavin ..... 100/222

(Continued)

FOREIGN PATENT DOCUMENTS

DE 29623908 U1 9/2000

(Continued)

OTHER PUBLICATIONS

English Translation of the Official Letter of Provisional Rejection of Japanese Application No. 2009-505 818 dated May 29, 2012.

*Primary Examiner* — Edward Tolan

*Assistant Examiner* — Lawrence J Averick

(74) *Attorney, Agent, or Firm* — Browdy and Neimark, PLLC

(57) ABSTRACT

The invention describes an apparatus for stamping can lids or the like, having a bridge (10) supported on a frame and carrying stamping tools (1) actuated vertically in a continuously repeating manner, having a longitudinal conveying device (30) gradually transporting metal sheets (11, 12) under said tools (1) in each case with the latter opened, and having a transverse conveying device (20, 40) laterally displacing to a limited extent the metal sheet (11, 12) moving or moved longitudinally in each case, wherein a separately controllable transverse conveying device (20, 40) is arranged in a stationary position in each case on the feed and discharge side approximately symmetrically to the tools (1) close in front of and behind the latter, said transverse conveying device (20, 40) in each case carrying a driving roller pair (31, 32; 51, 52) as the longitudinal conveying device (30, 50), which delivers the metal sheet (11, 12) in a controlled clamping manner or releases it in a controlled manner.

Furthermore, a method of using the apparatus described is presented.

17 Claims, 4 Drawing Sheets

U.S. PATENT DOCUMENTS

| | | | | | |
|---|---|---|---|---|---|
| 2,522,134 | A | * | 9/1950 | Sayre | 425/157 |
| 2,639,830 | A | * | 5/1953 | Weimont | 156/353 |
| 2,884,062 | A | * | 4/1959 | Taylor | 162/415 |
| 3,516,277 | A | * | 6/1970 | Bracco et al. | 72/446 |
| 3,620,158 | A | * | 11/1971 | Torelli et al. | 100/154 |
| 3,667,268 | A | * | 6/1972 | Rech | 72/133 |
| 3,675,462 | A | * | 7/1972 | Ponce | 72/428 |
| 3,815,403 | A | * | 6/1974 | Daniels | 72/405.02 |
| 3,834,217 | A | * | 9/1974 | Ducate | 72/446 |
| 4,076,231 | A | * | 2/1978 | Kutzner et al. | 493/342 |
| 4,289,230 | A | * | 9/1981 | McGee | 198/811 |
| 4,335,296 | A | * | 6/1982 | Bredow | 219/121.67 |
| 4,416,133 | A | * | 11/1983 | Doyle | 72/58 |
| 4,513,602 | A | * | 4/1985 | Sofy | 72/405.13 |
| 4,516,866 | A | * | 5/1985 | Yamauchi et al. | 400/25 |
| 4,607,477 | A | * | 8/1986 | Hinchcliffe et al. | 53/444 |
| 4,630,461 | A | * | 12/1986 | Votava | 72/405.12 |
| 4,650,063 | A | * | 3/1987 | Zierpka | 198/621.1 |
| 4,957,691 | A | * | 9/1990 | Brashier et al. | 376/245 |
| 4,984,728 | A | * | 1/1991 | Brinkmeier et al. | 226/172 |
| 4,994,232 | A | * | 2/1991 | Brashier et al. | 376/261 |
| 5,007,626 | A | * | 4/1991 | Blaimschein | 271/33 |
| 5,062,287 | A | * | 11/1991 | Brown et al. | 72/336 |
| 5,170,675 | A | * | 12/1992 | Kawashima | 74/89.33 |
| 5,222,854 | A | * | 6/1993 | Blatt et al. | 198/463.3 |
| 5,251,501 | A | * | 10/1993 | Katahira | 74/89.39 |
| 5,331,836 | A | * | 7/1994 | Cudzik | 72/346 |
| 5,337,594 | A | * | 8/1994 | Pettersson et al. | 72/446 |
| 5,370,214 | A | * | 12/1994 | Katahira | 198/345.1 |
| 5,385,040 | A | * | 1/1995 | Michael et al. | 72/405.1 |
| 5,423,202 | A | * | 6/1995 | Komatsu et al. | 72/405.16 |
| 5,454,278 | A | * | 10/1995 | Kasuga | 74/89.33 |
| 5,613,400 | A | * | 3/1997 | Sato et al. | 74/89.36 |
| 5,617,755 | A | * | 4/1997 | Cheers et al. | 72/349 |
| 5,623,849 | A | * | 4/1997 | Goff et al. | 72/394 |
| RE35,530 | E | * | 6/1997 | Hunt | 413/56 |
| 5,643,615 | A | * | 7/1997 | Austin | 425/186 |
| 5,655,201 | A | * | 8/1997 | Islam et al. | 399/322 |
| 5,727,416 | A | * | 3/1998 | Allgoewer | 72/405.11 |
| 5,899,109 | A | * | 5/1999 | Fisch | 72/405.16 |
| 5,915,916 | A | * | 6/1999 | Saji | 414/749.1 |
| 5,983,696 | A | * | 11/1999 | Maher | 72/405.16 |
| 6,191,548 | B1 | * | 2/2001 | Kajita et al. | 318/568.18 |
| 6,316,900 | B2 | * | 11/2001 | Kajita et al. | 318/568.18 |
| 6,520,680 | B2 | * | 2/2003 | Kato et al. | 384/45 |
| 6,571,932 | B1 | * | 6/2003 | Kawashima et al. | 198/494 |
| 6,821,345 | B2 | * | 11/2004 | Obermark | 118/227 |
| 6,843,171 | B1 | * | 1/2005 | Altman et al. | 100/207 |
| 7,093,709 | B2 | * | 8/2006 | Cotter et al. | 198/835 |
| 7,199,334 | B2 | * | 4/2007 | Friedman et al. | 219/385 |
| 7,237,421 | B2 | * | 7/2007 | Von Allwoerden | 72/335 |
| 7,370,507 | B2 | * | 5/2008 | Cook et al. | 72/405.13 |
| 7,556,144 | B2 | * | 7/2009 | Cotter et al. | 198/835 |
| 7,624,614 | B2 | * | 12/2009 | Heid et al. | 72/405.16 |
| 7,721,584 | B2 | * | 5/2010 | Tokunaga et al. | 72/405.09 |
| 7,748,249 | B2 | * | 7/2010 | Shiroza | 72/422 |
| 2002/0129634 | A1 | * | 9/2002 | Pierson et al. | 72/60 |
| 2003/0051794 | A1 | * | 3/2003 | Suda et al. | 156/123 |
| 2008/0127838 | A1 | * | 6/2008 | Baba et al. | 100/35 |
| 2010/0040750 | A1 | * | 2/2010 | Assaad et al. | 426/438 |
| 2011/0097552 | A1 | * | 4/2011 | Mancosh et al. | 428/172 |

FOREIGN PATENT DOCUMENTS

| | | | | |
|---|---|---|---|---|
| EP | 0616861 | A1 | | 3/1994 |
| EP | 0917918 | A2 | | 5/1999 |
| EP | 917918 | A2 | * | 5/1999 |
| JP | 1998-180380 | | | 11/1983 |
| JP | 1983-199630 | | | 7/1998 |
| JP | 2000-176566 | A | | 6/2000 |
| WO | 03037543 | A2 | | 5/2003 |

* cited by examiner

STAMPING APPARATUS WITH FEED DEVICE

The invention describes an apparatus for stamping can lids or the like, having a bridge supported on a frame and carrying stamping tools actuated vertically in a continuously repeating manner, having a longitudinal conveying device gradually transporting metal sheet plates under said tools in each case with the latter opened, and having a transverse conveying device laterally displacing to a limited extent the metal sheet moving or moved longitudinally in each case, as well as a method of controlling said apparatus.

Such a device is known from the DE 296 23 908 U1. This device provides the extensive utilisation of the area of a metal sheet plate by transporting the sheet plate longitudinally and/or transversally to positions distributed in a grid, in which at least one stationary stamping tool, which is moved continuously up and down and executes a stamping procedure. The conveying of the metal sheet is done by seizing its rear edge with gripping pliers, mounted on a compound carriage rest, which is moved in a controlled manner on a longitudinal carriage in the direction of feed in and discharge. A second configuration of gripping pliers, compound carriage rest and longitudinal carriage, offset vertically against the first configuration, provides, alternating with the latter, the feeding of closely successive metal sheet plates, which are to be processed, in such a way, that the stamping tool does not execute idle strokes during a changing of the sheet plates. After releasing the completely empty stamped metal sheet plate, the respective empty conveying device runs back to the trigger position, during the feed motion of the other. The precision of feeding makes it possible to perform the stampings in straightforward or preferably in diagonal rows with intervals of millimeters and accordingly accurate towards the edges, in such a way producing extremely minor cut-off waste. The metal sheets are often so thin that their stability is very low when stamped empty. The known device has a large construction length, having to contain at least two metal sheet plates in the direction of material flow.

Furthermore, from the EP 0 616 861 B2 a stamping apparatus with a double-row tool is known, having two rows equipped with stamping tools which arranged offset to each other, said apparatus providing a conveyor belt carrier for metal sheet plates, with catch pins provided at the front and rear edge of the sheet plates in the direction of transport, and with a further feed device respectively advancing a metal sheet plate, which is next to be processed via laterally acting grippers. The very expensive full equipment, which in addition requires a very stable carrying bridge to absorb the stamping forces, avoids a transversal conveying of the metal sheet plates.

Furthermore, from the DE 34 37 642 C2 a stamping apparatus is known, comprising two longitudinal transversal conveyors with gripping pliers, each acting with two grippers at one side of the metal sheet plate. The longitudinal conveying devices protrude from the stamping station by the length of a metal sheet plate, and thus serve also for the discharge of the gridlike empty stamped metal sheet plate. Hence, the longitudinal conveying devices extend across at least three metal sheet plate lengths.

It is the object of the invention, to simplify the initially mentioned stamping and feed device in such a way, that it becomes shorter and comprises fewer feeders and driving devices.

This object is met in such a way, that the apparatus for stamping can lids out of metal sheet plates being delivered sequentially by a feed table arranged at a front side of a stamping device, comprises a bridge supported on a frame and carrying stamping tools actuated vertically in a continuous repeating manner, in that frame in a stationary position on a feed side close in front of said tools is arranged a first transverse conveying device carrying a first longitudinal driving roller pair, as a first longitudinal conveying device, one of said driving rollers is vertically adjustable by compressed air actuators and the other one of said driving rollers is driven by a longitudinal positioning motor, thereby gradually transporting in a controlled clamped manner the metal sheet plates passing through said tool, further in a stationary position on a discharge side close behind of said tools is arranged a second transverse conveying device carrying a second driving roller pair as a second longitudinal conveying device, one of said driving rollers is vertically adjustable by compressed air actuators and the other one of said ding rollers is driven by a longitudinal positioning motor, thereby delivering the metal sheet plates in a controlled clamping manner or releases it in a controlled manner, both the transverse conveying devices are arranged approximately symmetrically to the tools and are separately movable by controllable linear drives, thereby laterally displacing the respective longitudinal driving roller pairs to a limited extent.

Advantageous embodiments and operating procedures are indicated in the subclaims.

The two driving rollers, each extending across a maximum metal sheet plate width, are mobile on a transverse carriage conveyor, respectively, so that a metal sheet plate clamped between at least one roller pair respectively, can be positioned by said rollers crossways in the conveying direction and with the carriage conveyor, this way all stamping positions can be accessed with only one or more stamping tools, as it is required for a complete stamping out. Both the rollers and the transverse conveyors are accordingly actuated with precisely positioning motors.

Preferably, each carriage is connected by a spindle drive to a drive motor, which is stationary mounted at a support frame, however, other linear positioning systems can be provided.

The roller drive motor, too, is preferably fixed to a frame and by means of a driving shaft connected with a coupling element movable thereupon to the roller.

The conveying roller pairs have one roller respectively, the distance of which is adjustable in such a way that in one position the rollers provide a wide gap, through which a stamping sheet can freely move, and in the other position the rollers are pressed against each other so that a sheet positioned in between is conveyed in an exact manner when the activated roller is revolving. The support of the adjustable pressure roller for example, is borne in pin supports or in pivoted levers at the carriage. One compressed air valve and one counter-spring respectively provide the force to open and close the rollers at both end-sided supports.

Furthermore holding-down clamps are advantageously arranged on one or both sides of each roller pair on the carriage, said clamps being raised or pushed open, preferably by means of an electromagnet, against a counter spring. By closing the holding-down clamp, the sheet next to the stamping tool is steadied and retained, so that it cannot buckle in the roller during the stamping or a sole transverse conveyance. During the conveying of a metal sheet plate through one of the driving roller pairs, the holding-down clamps of the latter are raised, to let the metal sheet plate pass freely.

The exact alignment of a sheet plate edge vertical to the conveying direction is monitored by position sensors, which function optically, electromagnetically or mechanically. The sensor signals are used by a control device for the corrective control of the drive motors as well as the pressure devices and the holding-down clamps.

Since the conveyor rollers have a certain elasticity, their diameter changes depending on the pressure force, so that a roller, which is pressed only from one side, causes a torque to the sheet plate, which leads to its alignment, if the other roller pair is opened in a controlled manner or not crossed by the metal sheet plate, with the holding-down clamps accordingly open or one of them closed only on one side in an appropriate way.

A particularly effective angle position correction of a metal sheet plate is effected when the two roller pairs are pressed unilaterally at their respective opposite ends and are activated synchronously or with varying rotational speed or direction or when the carriages are moved slightly against each other.

The position sensors or state sensors are advantageously arranged at the carriages at the feed and/or the discharge side of the rollers. Preferably, they are arranged in alignment with one another in both conveying directions, so that all edges are calibrated to their position and the angle correction can be regulated through the angle difference.

When a new sheet plate is fed in, the metal sheet plates are positioned to each other in such a way, that the edges follow back-to-back, and the stampings can be executed consecutively one after another without an idle stroke.

A new metal sheet plate is transferred directly to the first driving roller pair, where it is seized and forwarded. The empty stamped sheet plate is fed by the second driving roller pair with increased speed directly across a slide or roller table to a downstream stacker plate, in such a way no additional area is wasted and an extraction device can be omitted.

Since different products are produced on the stamping and pressing apparatus, such as can lids, flat top cans, etc., which are ordered in different quantities, it is sufficient in many cases, to provide only one stamping tool, which saves considerably on tooling costs, but requires overall a longer throughput of metal sheet plates. If larger quantities are required, it is appropriate to provide several tools on the bridge, so that accordingly the quantity output of the plant rises, and the number of transversal positionings in a row decreases.

In an advantageously shaped feed device the metal sheet plate is fed into the feed sided driving rollers when the roller gap is open by means of conveyor belts or the like, with a row of fixed edge guides aligning the metal sheet plate, by pushing and pressing it on the fixed guides by means of laterally movable catches affecting force charging at the opposite edge. The stops are advantageously equipped with concave rollers; this way the conveyor belts provide virtually no resistance against the conveying movement. A metal sheet plate aligned in such a way after entering into the gap and after the feed sided driving rollers have been closed is seized between the latter, and forwarded without delay, so that a further alignment control is generally dispensable.

To make possible a transversal transport of the metal sheet plate on the feed table without inhibition, the stops are lowerable under the table surface as shown schematically in FIG. 4, section A-A. This is done by laterally deviating each of them by means of a pneumatic, electric or the like controllable drive, which is presented schematically. Likewise, the feed drives at the belt supports are retracable by control elements.

An advantageous embodiment is shown in FIGS. 1 and 3.

Figure 1:
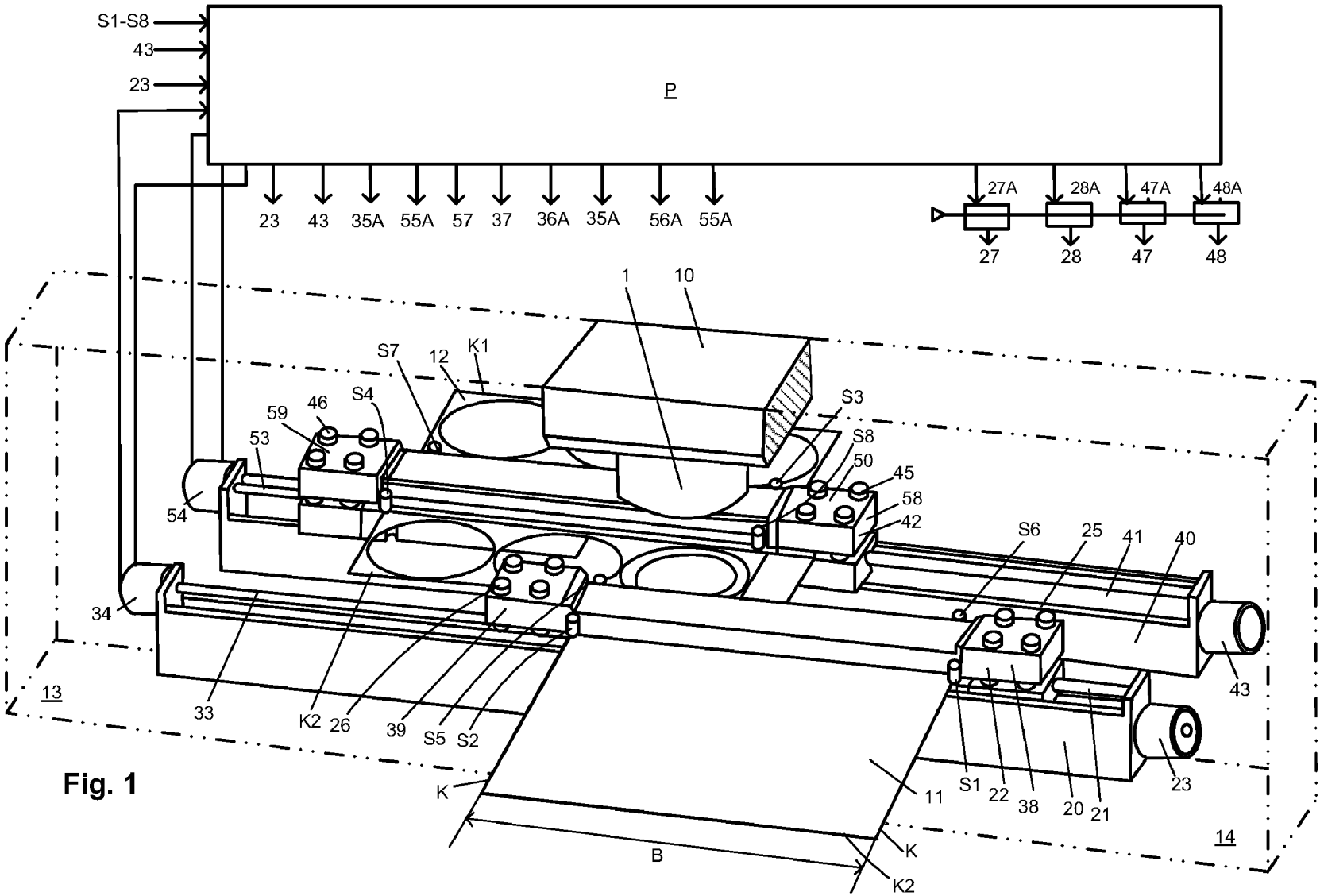
FIG. 1 shows an overview perspective, where the support frame and the stamping bridge are shown only in a rudimentary way.

FIG. 1 shows schematically at two sides a support frame 13, 14, on which two transverse conveying devices 20, 40 are mounted with their positioning drive motors 23, 43 and with motors for the roller drives 34, 54. A bridge 10 extends in between of the support frame 13, 14, shown only in a rudimentary way, said bridge carrying a stamping tool 1, a die-plate 1A being arranged coaxially underneath the tool in the support frame. The two transverse conveying devices 20, 40 consist of one carriage rail 21, 41 each, extending across at least two maximum metal sheet plate widths B.

One carriage 22, 42 is supported in each carriage rail 21, 41 in a transversally movable way, said carriage being connected with a linear drive, which for example here is a spindle drive, whose drive motor 23, 43 drives a spindle, not visible in the figure, which extends along the carriage rail arrangement and through the carriage 22, 42, inside which a spindle nut is mounted.

Two driving rollers are mounted one above the other in each carriage 22, 42, the lower one being driven by means of a driving shaft 33, 53 by the roller drive motor 34, 54 and the upper one functions as a pressure roller. Each upper roller is supported in a vertical rail 25, 26; 45, 46 at both ends in bearing supports 38, 39; 58, 59 in a vertically movable way and can be brought to a releasing and a clamping position by means of a compressed air cylinder and an antagonist spring. In this way a metal sheet plate 11, 12, located in the gap between the rollers, is fed in the direction of flow by the respectively driven roller drive, when the cylinder is aerated with compressed air, which is done by means of the controllable compressed air (i.e., pneumatic) valves 27A, 28A; 47A, 48A. Thus the controllably driven roller pairs 31, 32; 51, 52 in FIG. 2 serve as longitudinal conveying devices 30, 50.

By means of position sensors S1-S8 arranged at the carriages 22, 42 the parallel orientation of the edges K of the metal sheet plates 11, 12 can be recognized in the conveying device. In particular, the infeed of the leading edge K1 and the discharge of the rear edge K2 as well as the parallel situation of the edges K1, K2 can be monitored by means of the exactly aligned sensors S1-S8, closely arranged to the roller bearings. Optical, electromagnetic and mechanical scanners are suitable.

Figure 2:
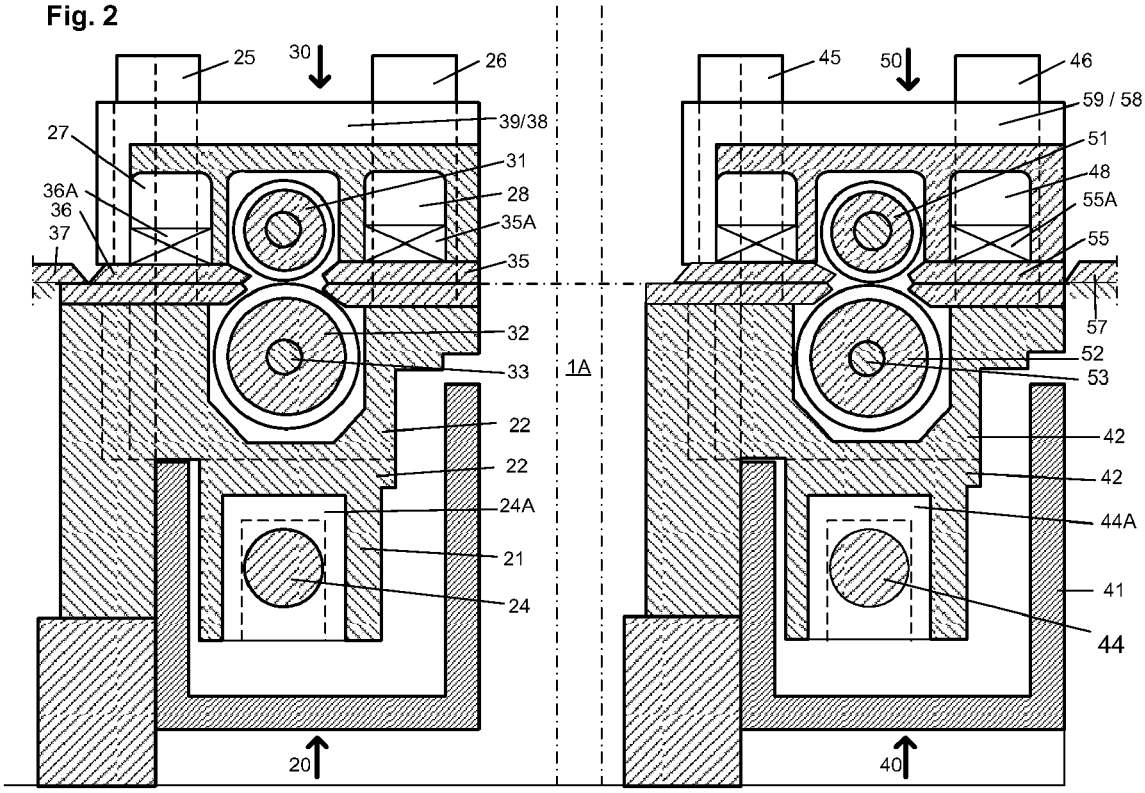
FIG. 2 shows a cross-section of the two carriages supporting the rollers.

The signals from the sensors S1-S8 are supplied to a control processor, which contains an operating program, controlling the drive motors 23, 34; 43, 54, the controllable compressed air valves 27A, 28A; 47A, 48A and the electromagnetic holding-down clamps 35, 36, 37; 55, 56, 57 in FIG. 2. The controllable compressed air valves connect the pneumatic actuator of the roller bearings with either a compressed air dispenser PL or a vent pipe.

FIG. 2 shows the two longitudinal conveying devices in cross section, with the stamping tools 1, 1A omitted. At the bottom of the figure respectively the carriage rail 21, 41 is arranged, in which the carriage 22, 42 is supported movably in the perspective of the figure. In the carriage 22, 42 respectively one driving roller pair is supported, under which a spindle nut 24A, 44A runs on a spindle 24, 44.

The lower roller 32, 52 is supported on a driving shaft 33, 53 turning with it but axially movable. In the upper bearing supports 38, 39; 58, 59, the pressure roller 31, 51 is supported in such a way that it can be lifted and lowered, for that purpose the pedestals 38, 39; 58, 59 have vertical rails in columns 25, 26; 45, 46 which are fixed on the carriage 22, 42.

The pedestals are respectively charged symmetrically by pneumatic cylinders 27, 28; 47, 48 in the direction of pressing and by not shown springs in the direction of lifting. Of course also a double-acting two-way pneumatic or a reversal of the effecting direction of the spring and of the pneumatic is to be provided, alternatively.

At the feed side and the discharge side of the roller pairs respectively, holding-down clamps 36, 35; 55, 56 are arranged on the carriage 22, 42, said clamps being pushed in a holding-down position against the force of a not shown spring or lifted respectively by an electromagnet 36A, 35A; 55A, 56A Since the magnets 35A, 36A; 55A, 56A can be controlled individually, a metal sheet plate 12 can be clamped on both sides of the tool during stamping the last row of holes, and a new sheet plate 11 can be fed at the same time with opened holding-down clamp 36 at the access side and pressed roller 31 on the feed side to a sheet plate edge to sheet plate edge position, as shown in FIG. 1.

Accordingly, the two holding-down clamps 35, 55 next to the stamping tool are closed during the stamping of the first row of holes and the holding-down clamp 56 at the discharge side is opened so that the completely stamped, gridlike metal sheet 12 can be ejected with increased speed. Preferably it proceeds across a slide table, rolling table or the like to a stack. On the feeding side too, a slide table is provided, illustrated in FIG. 3, which allows moving the metal sheet plate in every direction.

Figure 3:
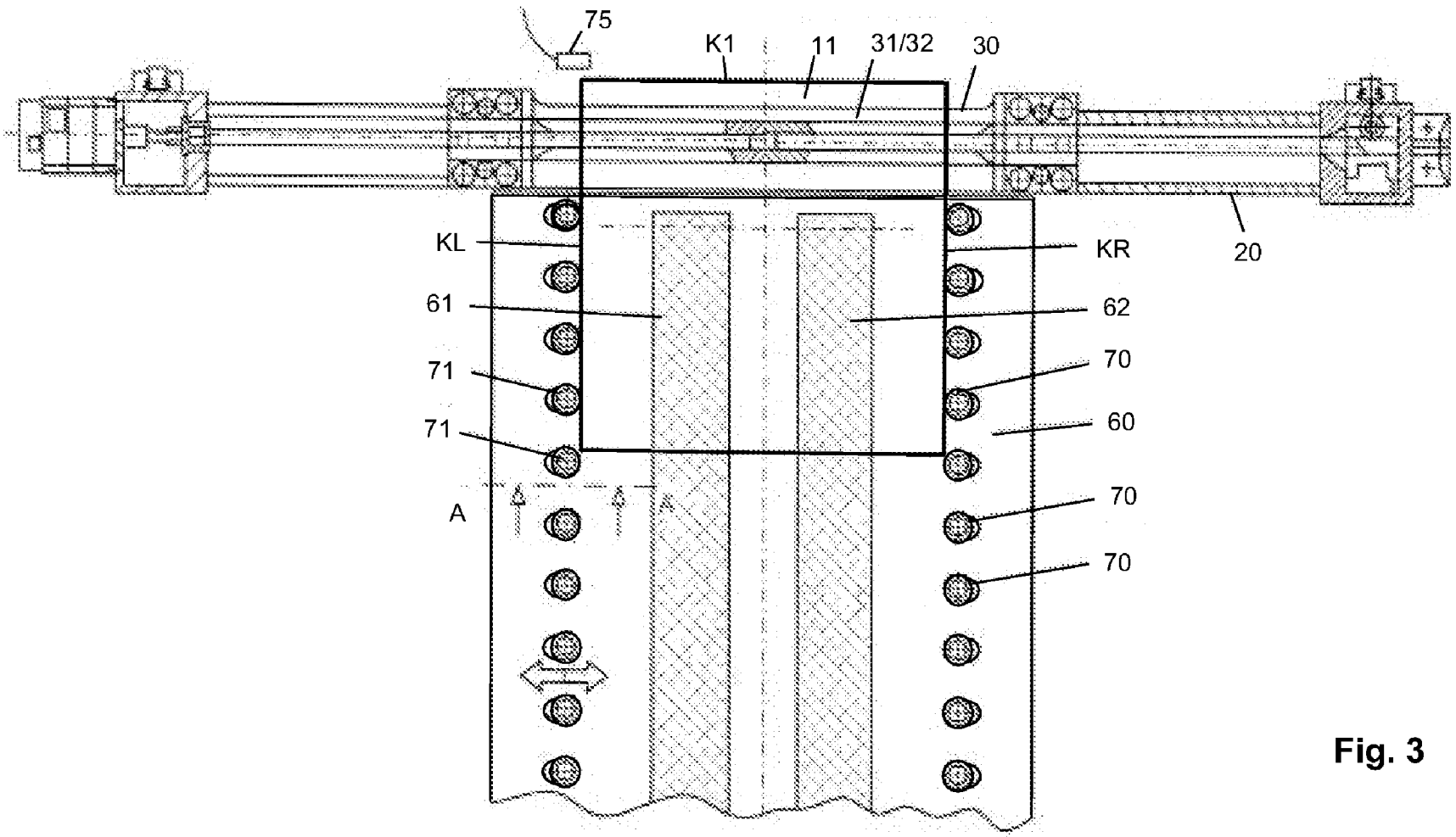
FIG. 3 shows a feed device at the additional driving roller pair in top view.

Additional holding-down clamps 37, 57 in FIG. 3 on the feeding and the discharge side are schematically shown, said clamps being controllable and serving to steady the metal sheet plate after fast feed movements and during the stamping.

FIG. 3 shows a feed table 60 in front of a longitudinal conveying device 30 with a metal sheet plate 11 inserted in opened rollers 31, 32, said sheet plates leading edge K1 being close to the edge sensor 75, which controls the closing of the feed rollers 31, 32.

On the feed table 60 two feed conveyors 61, 62 are retractably arranged under its surface as an example for conveyance means, furthermore buffer rollers 70, engaged against fixed stops, against said rollers the right edge KR of the metal sheet plate 11, on the right side in the figure, is pressed force-fit by the pressure and aligning rollers 71 arranged on the other side, with the feed conveyors 61, 62 being controllable in a lowered position.

After the orientation and feeding with the feed conveyors 61, 62 to the detection by means of the edge sensor 75, the feed rollers come into action, and the feed table 60 is released for the transverse and longitudinal conveying, by lowering the aligning means and the band conveyor means.

Figure 4:
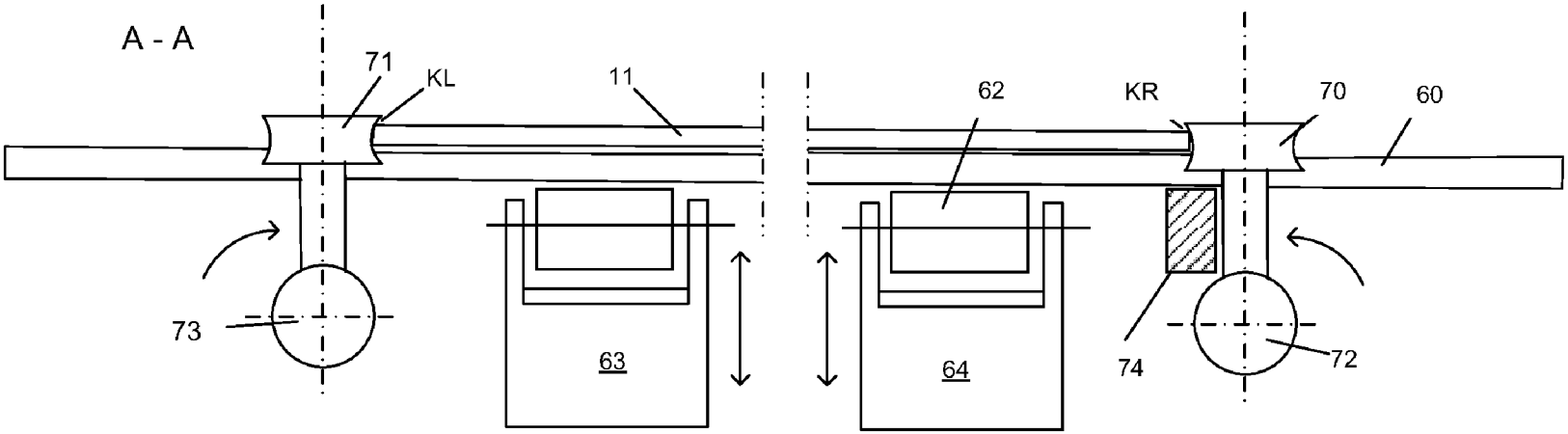
FIGS. 4 and 5 show schematically a section A-A to FIG. 3 in various states.
Figure 5:
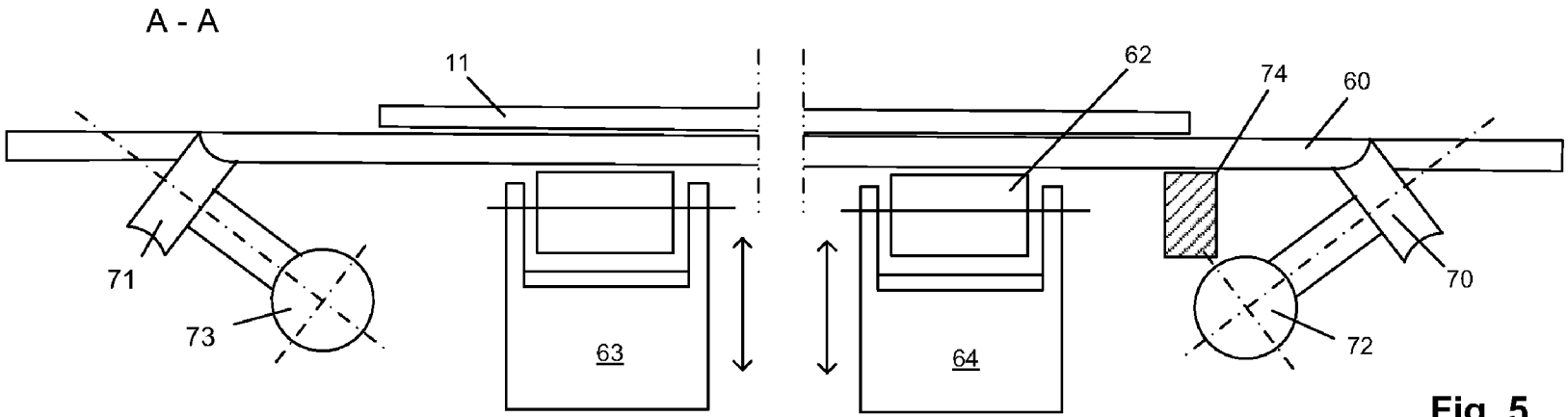

FIGS. 4 and 5 show a cross-section A-A of the feed table 60 with a metal sheet plate 11 laid upon it, FIG. 6 illustrating the state of aligning, with the right edge KR in the picture pushed against a stop 74 provided with a roller, while the aligning rollers 71 pressing respectively with a force on the opposite left edge KL determine the lateral position. The feed conveyors 61, 62 are lowered by the conveyor lifting gears 63, 64.

FIG. 5 shows the feeding position, in which the conveyor belts are lowered at their deflector rollers by the conveyor lifting gears 63, 64 and the centring rollers 71, 70 are laterally deviated by swivel devices 73, 72, so that a free relocatability is given in the feed device and transverse to it during the individual feed and stamping steps.

Preferably, the pressure and aligning rollers 70, 71 are provided with concave profiles, so that the metal sheet left edge KL and right edge KR take a precise position, when the swivel device 72 of the buffer roller 70 has taken the position at the stop 74.

REFERENCES

1, 1A stamping tools
10 bridge
11 metal sheet plate, being fed in
12 metal sheet plate, being discharged
13, 14 support frame
20 feed sided transverse conveying device
21 carriage rail
22 carriage
23 positioning drive motor
24 spindle drive with shaft joint
24A spindle nut
25, 26 vertical rails
27, 28 pneumatic actuator
27A, 28A control valves
30 feed sided longitudinal conveying device
31, 32 feed sided driving roller pair
33 driving shaft of the roller
34 positioning motor for roller drive
35, 36 holding-down clamps on carriage
35A, 36A electromagnet/spring
37 additional holding-down clamp
38, 39 pedestal
40 discharge sided transverse conveying device
41 carriage rail
42 carriage
43 positioning drive motor
44 spindle drive with shaft joint
44A spindle nut
45, 46 vertical rails
47, 48 pneumatic actuator
47A, 48A control valves
50 discharge sided longitudinal conveying device
51, 52 discharge sided driving roller pair
53 driving shaft
54 positioning motor for roller drive
55, 56 holding-down clamps on carriage
55A, 56A electromagnet/spring
57 additional holding-down clamp
58, 59 pedestal
60 feed table
61 1. feed conveyor
62 2. feed conveyor
63 1. conveyor lifting gear
64 2. conveyor lifting gear
70 buffer rollers
71 pressure and aligning rollers
72 swivel device for buffer rollers
73 swivel device for pressure rollers
74 stop
75 edge sensor
B metal sheet plate width
K metal sheet plate edges
K1 front edge
K2 rear edge
KR right edge
KL left edge
P control processor
PL compressed air
S1-S8 position sensors

The invention claimed is:

1. Apparatus for stamping can lids out of metal sheet plates being delivered sequentially by a feed table (60) arranged at a front side of a stamping device, comprising:

a bridge (10) supported on a frame and carrying stamping tools (1) actuated vertically in a continuous repeating manner, in that frame, in a stationary position on a feed side close in front of said tools (1) is arranged a first transverse conveying device (20) carrying a first longitudinal driving roller pair (31, 32), as a first longitudinal conveying device one of said first driving rollers (31) is vertically adjustable by compressed air actuators (27, 28) and the other one of said first driving rollers (32) is driven by a longitudinal positioning motor (34), thereby gradually transporting in a controlled clamped manner the metal sheet plates (11, 12) to pass between said tools (1), in a stationary position on a discharge side close behind of said tools (1) is arranged a second transverse conveying device (40), carrying a second driving roller pair (51, 52) as a second longitudinal conveying device, one of said second driving rollers (51) is vertically adjustable by compressed air actuators (47, 48) and the other one of said second driving rollers (52) is driven by a longitudinal positioning motor (54), thereby delivering the metal sheet plates (11, 12) in a controlled clamping manner or releases the metal sheet plates (11, 12) in a controlled manner, and wherein both the transverse conveying devices (20, 40) are arranged approximately symmetrically to the tools (1) and are separately movable by controllable linear drives (23, 43), thereby laterally displacing the respective longitudinal driving roller pairs (31, 32; 51, 52) to a limited extent.

2. Apparatus according to claim 1, wherein each of the transverse conveying devices (20, 40) respectively consist of a stationary carriage rail (21, 41) with a carriage (22, 42) bearing the driving roller pairs (31, 32; 51, 52), which extends across one maximum metal sheet plate width (B), and which, controlled by the linear drive (23, 43), can be moved across at least two maximum metal sheet plate widths (B) in the carriage rail (21, 41).

3. Apparatus according to claim 2, wherein each of the linear drives activates the respective carriage (22, 42) by means of a positioning drive motor (23, 43) via a spindle drive (24, 44).

4. Apparatus according to claim 2, wherein from each of the roller pairs (31, 32, 51, 52) at least one of the driving rollers (32, 52) respectively, is axial shiftable mounted and turning with a corresponding driving shaft (33, 53), which ends at the frame and is actuated there by the corresponding longitudinal positioning motor (34, 54).

5. Apparatus according to claim 4, wherein from each roller pair (31, 32, 51, 52) one of the driving rollers (31, 51) respectively, is supported movably at both ends in pedestals (38, 39; 58, 59) on the carriage (22, 42) in vertical rails (25, 26; 45, 46) and adjustable vertically by means of the corresponding pneumatic actuator (27, 28; 47, 48).

6. Apparatus according to claim 1, further comprising an electromagnetically operated holding-down clamp (35, 36; 55, 56) is arranged on the carriage (22, 42) respectively at the feed side and/or the discharge side of each roller pair (31, 32; 51, 52).

7. Apparatus according to claim 6, wherein one of the holding-down clamps (36, 55) at the feed side and discharge side respectively, is arranged next to the tools (1), or that additional holding-down clamps (37, 57) are arranged there, towards the side of the carriage or the side of the frame.

8. Apparatus according to claim 1, further comprising position sensors (S1-S8) of the sheet metal plate edges (K, K1, K2) are arranged at the carriages (22, 42) and/or the carriage rail (21, 41), the signals of said sensors controlling the positioning motors (34, 54) of the roller pairs (31, 32; 51, 52) via a control processor (P) in such a way that the metal sheet plate side edges (KL, KR) are conveyed parallel to the conveying directions, and that consecutive metal sheet plates (11, 12) are flush.

9. Apparatus according to claim 1, wherein the feed table (60) carries under its surface retractable feed devices (61, 62) and lowerable aligning devices (70, 71), which in an activated state are adjusted in one feeding direction, and are in force-fit contact with the corresponding side edges (KL, KR) of the fed-in metal sheet plate (11).

10. Apparatus according to claim 9, wherein the feed devices (61, 62) are parallel conveyor belts, which can each be lifted and retracted with respect to the surface of the feed table (60) by a conveyor lifting gear (63, 64).

11. Apparatus according to claim 9, wherein the aligning devices (70, 71) consist of two rows of stops and aligning axes, staffed with concave profiled rollers, each row pivoting around an axis of rotation orientated in the feed direction and situated below the surface of the table, and in such a way being disposable in a vertical alignment position and in a lowered position below the surface of the table.

12. Method for the control of the apparatus according to claim 1, on the bridge (10) of said apparatus one tool (1) or several of the tools (1) being arranged side by side, with a metal sheet plate (11) being fed transversally in each stamping row step by step until all stamping positions have been stamped out, and then transported in a neighbouring stamping row, forward in a longitudinal feed step either only with the longitudinal drive roller pairs, or vectored diagonally in combination with the transverse conveying device (20, 40), wherein the holding-down clamps (35, 36; 55, 56) of one of the carriages (22, 42) are only released in a controlled manner if at least one of the corresponding driving roller pairs (31, 32; 51, 52) is activated.

13. Method according to claim 12, wherein the compressed air actuators (27, 28; 47, 48) of one of the driving roller pairs (31, 32; 51, 52) are only released in a controlled manner when a front edge (K1) of a metal sheet plate (11), parallel to the roller pair, is fed into the first roller pair (31, 32; 51, 52), or if the second roller pair is closed in a controlled manner.

14. Method according to claim 13, wherein the pneumatic actuator (27, 28) of the feed-sided roller pair (31, 32) which is positioned at the advanced side of the metal sheet plate (11) is released in a controlled manner, until a given position of the front edge (K1) in the conveying direction is reached.

15. Method according to claim 12, wherein the first and the second driving roller pairs (31, 32; 51, 52) and/or the transverse conveying devices (20, 40) are activated synchronously, if a metal sheet plate (11) is located in both said roller pairs.

16. Method according to claim 13, wherein when a last stamping row is stamped out from a metal sheet (12), only the tool-sided holding-down clamp (35) of the feed-sided driving roller pair (31, 32) is kept open and said roller pair advances the subsequent metal sheet plate (11) with its front edge (K1) against a rear edge (K2) of the processed metal sheet (12) and aligns it.

17. Method according to claim 12, wherein when the last stamping on a metal plate (11) takes place, only the tool-sided holding-down clamp (35) of the discharge-sided driving roller pair (51, 52) is kept open, and the closed discharge-sided driving roller pair (51, 52) discharges the empty stamped metal sheet at a high speed.

* * * * *